United States Patent [19]

Iversen

[11] Patent Number: 4,794,977

[45] Date of Patent: Jan. 3, 1989

[54] MELT SPIN CHILL CASTING APPARATUS

[76] Inventor: Arthur H. Iversen, 15315 Sobey Rd., Saratoga, Calif. 95070

[21] Appl. No.: 938,281

[22] Filed: Dec. 5, 1986

Related U.S. Application Data

[63] Continuation-in-part of Ser. No. 716,815, Mar. 27, 1985, abandoned.

[51] Int. Cl.[4] ..... B22D 11/06

[52] U.S. Cl. ..... 164/423; 164/429; 164/443

[58] Field of Search ..... 164/423, 427, 429, 443, 164/463, 479

[56] References Cited

U.S. PATENT DOCUMENTS

| | | | |
|---|---|---|---|
| 2,825,108 | 3/1958 | Pond | 164/423 X |
| 2,899,728 | 8/1959 | Gibbons | 164/423 X |
| 3,433,632 | 3/1969 | Elbert et al. . | |
| 3,845,810 | 11/1974 | Gerding | 164/429 |
| 3,862,658 | 1/1975 | Bedell | 164/423 X |
| 3,881,540 | 5/1975 | Kavesh | 164/423 X |
| 3,938,583 | 2/1976 | Kavesh | 164/429 X |
| 4,142,571 | 3/1979 | Narashimhan | 164/429 X |
| 4,281,706 | 8/1981 | Liebermann et al. | 164/423 X |
| 4,307,771 | 12/1981 | Draizen et al. | 164/423 X |
| 4,405,876 | 9/1983 | Iversen | 313/30 |
| 4,455,504 | 6/1984 | Iversen | 313/30 |
| 4,489,772 | 12/1984 | McLane et al. | 164/423 |
| 4,489,773 | 12/1984 | Miller | 164/463 |
| 4,502,528 | 3/1985 | Frissora et al. | 164/443 X |
| 4,537,239 | 8/1985 | Budzyn et al. | 164/423 |
| 4,622,687 | 11/1986 | Whitaker et al. | 313/30 X |
| 4,684,844 | 8/1987 | Iversen | 313/30 |

FOREIGN PATENT DOCUMENTS

| | | | |
|---|---|---|---|
| 57-187147 | 11/1982 | Japan | 164/423 |
| 57-190753 | 11/1982 | Japan | 164/423 |
| 57-190754 | 11/1982 | Japan | 164/423 |
| 59-42160 | 3/1984 | Japan | 164/423 |

OTHER PUBLICATIONS

Greenspan, *The Theory of Rotating Fluids,* 1969, pp. 271–275.

Gambill, W. R. et al., "Boiling Burnout With Water In Vortex Flow," Chemical Engineering Progress, vol. 54, No. 10, Oct., 1958, pp. 68–76.

*Primary Examiner*—Nicholas P. Godici
*Assistant Examiner*—J. Reed Batten, Jr.
*Attorney, Agent, or Firm*—Foley & Lardner

[57] ABSTRACT

A liquid cooled melt spin chill casting apparatus suitable for melt spin chill casting of molten metals or other materials wherein a heat transfer rate capability greater than the heat load of the molten material is achieved. Structures produce multiple strands of material and strands of predetermined length. Additionally, the length of time the material is retained in contact with the casting wheel is controlled.

39 Claims, 8 Drawing Sheets

MELT SPIN CHILL CASTING APPARATUS

CROSS REFERENCE TO RELATED APPLICATION

The present application is a continuation-in-part of co-pending U.S. patent application Ser. No. 716,815, filed Mar. 27, 1985, now abandoned.

BACKGROUND OF THE INVENTION

This invention relates to Rapid Solidification Processing (R.S.P.) techniques and more particularly to melt spin chill casting wherein quench rates and heat flux dissipation higher than the prior art are achieved.

Melt spin chill casting is a method wherein a jet of hot molten material, generally metal, impinges upon a chilled moving quench (chill) surface and the molten material is rapidly quenched, at rates of $10^3$ to $10^7$ °C./sec. This technique has been employed to produce polycrystalline products possessing very fine crystalline structure and more recently to produce glassy or amorphous metal filaments having superior commercially interesting physical properties.

A critical factor in both the ability to prove the needed high quench rates and to obtain economical production rates is the ability of the rotating quenching wheel to efficiently and rapidly remove the heat yielded by the rapidly chilled material. Complete quenching should be effected before centrifugal forces cause the solidified material to leave the wheel. Reference in this regard is made to U.S. Pat. No. 3,862,658 issued Jan. 28, 1975 to Bedell.

Efficient and effective melt spin chill casting depends upon two parameters. One is that the heat be removed from the rotating quench wheel as rapidly as it is transferred from the molten material an the second is that the temperature of the chill surface be maintained as low as possible to obtain the highest possible quench rate. To meet these requirements, hollow liquid cooled casting wheels have been developed.

Examples of such devices are described in U.S. Pat. Nos. 4,307,771 issued Dec. 29, 1981 to Draizen et al.; 4,489,773 issued Dec. 25,1984 to Miller; 3,881,540 issued May 6, 1975 to Kavesh; 4,281,706 issued Aug. 4, 1981 to Liebermann et al; 3,938,583 issued Feb. 17, 1976 to Kavesh; 3,845,810 issued to Gerding on Nov. 5, 1974, 4,502,528 issued to Frissora et. al. on Mar. 5, 1985; and 4,537,239 issued to Budzyn et. al. on Aug. 27, 1985. Other examples of such devices are found in Japanese Pat. Nos. 57-187147 (Nov. 17, 1982); 57-190753 (Nov. 24, 1982); 57-190754 (Nov. 24, 1982); and 59-42160 (Mar. 8, 1984).

Other examples of casting wheels are provided in U.S. Pat. Nos. 2,825,108 issued Mar. 4, 1958 to Pond, and 2,899,728 issued to Gibbons, and 4,142,571 issued Mar. 6, 1979 to Narasimhan.

The prior art liquid cooled casting wheels, however, provide relatively low rates of heat removal from the chill surface; the devices tend to be subject to deficiencies on the flow of liquid coolant, such as, for example, cavitation, and generation of stable flow patterns. Thus, in order to provide adequate lateral diffusion of heat to spread the heat load and prevent burn out, relatively thick chill walls (i.e. a large distance between the chill surface on which the molten metal impinges and the heat exchange surface are often necessitated.

Further, such devices tend to require high velocity differentials between the chill wheel surface and molten metal jet to provide adequate heat transfer. This high velocity tends to cause geometric distortion of the molten metal when it strikes the chill wheel surface, making production of wide continuous sheets of material difficult; current devices are capable of effectively producing ribbons of only a few centimeters in width.

SUMMARY OF THE INVENTION

The present invention provides a melt spin chill casting apparatus, capable of high volume output, producing sheets of materials having substantial width, and having extended life with resultant economy of operation.

This is achieved by providing the capability to dissipate heat fluxes greater than those arising from solidifying metals or other materials. A melt spin chill casting wheel with a relatively thin chill wall thickness and higher quench rates than theretofore possible, and which can operate at a relatively low rotational velocity can thus be provided.

Specifically, in accordance with one aspect of the invention, an improved liquid cooled heat exchange surface provides for a flow of coolant liquid to remove heat from the heat exchange surface by formation of nucleate vapor bubbles on the heat exchange surface. Pressure gradients, having a component perpendicular to the heat exchange surface, are formed in the liquid without substantially impeding the relative velocity between the heat exchange surface and the liquid, and having a magnitude directly proportional to the square of the relative velocity between the heat exchange surface and the liquid, to facilitate removal of said nucleate bubbles.

BRIEF DESCRIPTION OF THE DRAWINGS

Preferred exemplary embodiments of the present invention will hereinafter be described in conjunction with the appended drawing wherein like numerals denote like elements and.

DESCRIPTION OF PREFERRED EXEMPLARY EMBODIMENTS

The present invention relates to improvements in melt spin chill casting apparatus for producing materials having controlled physical properties from a molten stream impinging on a chill casting wheel. Physical properties may be tailored, ranging from microcrystalline to amorphous, in a wide number of materials, ranging from metals to ceramics to glasses. Regardless of the desired properties in a selected material, a process parameter of crucial importance is the cooling rate relative to the optimum heat flux threshold for quenching the specific material to yield the desired properties. The chill casting apparatus of the present invention advantageously facilitates achieving cooling rates at least equal to that optimum heat flux threshold over a wide temperature range as will be seen hereinbelow.

Figure 1:
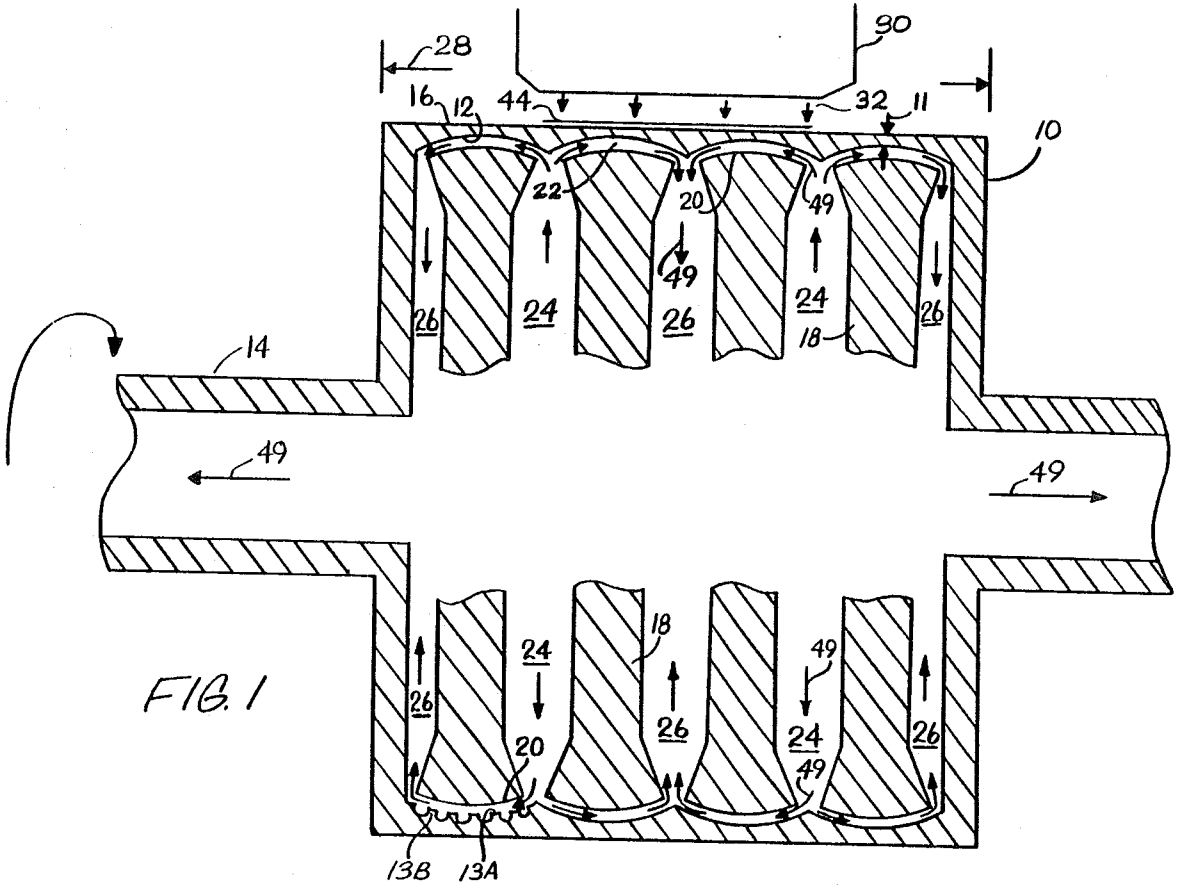
FIG. 1 is a cross-sectional view of the present invention illustrating a rotating circumferential chill surface.

Referring now to FIG. 1, a first embodiment of a melt spin chill casting wheel 10 in accordance with the present invention is rotatably attached to hollow rotating shaft 14. A jet of molten material 32 is directed from a crucible 30 to impinge upon the outer circumferential surface 16 of wheel 10. surface 16 serves as the chill surface for solidification of hot molten metals, ceramics, etc. A heat exchange surface 12 is provided on the interior of surface 16, underlying the chill surface. Liquid coolant 49 flows in contact with heat exchange surface 12. Heat from molten material 32 is transferred to chill surface 16 through the chill wall 11 to heat exchange surface 12, and therefrom into coolant liquid 49. The desired heat transfer mechanism from the heat exchange surface 12 into liquid 49 is the formation of nucleate bubbles at the heat exchange surface.

Hollow shaft 14 serves as a input and output conduit for the liquid coolant. If desired, a sealed closed-loop liquid cooling system containing a substrate structure with further heat exchange means (not shown) connected to a suitable second thermally-related refrigeration system may be employed. The closed loop containing the substrate is filled with a dielectric coolant such as fluorocarbon refrigerant #113 or #114 B2 which boil at about 47° C. (118° F.). With refrigerants #113 or #114B2, the sealed loop would be substantially at atmospheric pressure inasmuch that in all reasonable environments the temperature is likely to be below the boiling point of 47° C. (118° F). Alternatively, the sealed loop containing the substrate may be filled with with a low-temepature coolant such as refrigerant #12B1 which boils at −58° C. In these circumstances, the sealed loop will be under great pressure at room temperature (25° C.), and special construction will be required to prevent distortion of the chill wheel.

The use of non-conductive refrigerant coolants, such as fluorocarbons, high or low temperature, has the further benefit of avoiding corrosion as occurs with water. This reduces maintainance costs and, more importantly, the associated downtime and consequent loss of production.

In accordance with one aspect of the present invention, a chill wheel is provided whereby heat fluxes greater than those arising from solidifying liquid material can be dissipated, thus facilitating use of thinner chill walls (i.e., less distance between the chill surface and heat exchange surface), and concomitant increased quench rates.

It is known that the most efficient method for liquid cooling a heat exchange surface is by nucleate boiling while the liquid is in turbulant flow over the heat exchange surface. Reference in this regard is made to the work of Gambill and Greene at Oak Ridge National Laboratories (Chem. Eng. Prog. Vol. No. 54,10, 1958).

U.S. Pat. Nos. 4,405,876, issued Sept. 20, 1983, and 4,455,504, issued June 19, 1984, to A. Iversen and 4,622,687 issued Nov. 11, 1986, to Whitaker and Iversen, all commonly owned with the present invention, describe the application of turbulent flow liquid cooling techniques to vacuum tubes.

To provide for dissipation of heat fluxes in excess of those generated by the casting process, pressure gradients for facilitating removal of nucleate bubbles from the heat exchange surface are generated in the coolant liquid. The internal liquid cooled heat exchange surface 12 are concave curved in shape, preferably in the form of flutes with cusps. Multiple adjacent curved surfaces 12 may be provided to provide a chill surface width 28 of arbitrary dimensions. An example of a wheel formed of multiple surfaces 12 will be described in conjunction with FIGS. 7–9.

Flow diverters 18 are provided with convex curved surfaces 20 which are placed in close proximity to heat exchange surfaces 12, forming a conduit 22 for the precise control of the flow of liquid coolant 49 over heat exchange surface 12. In general, curves 12 and 20 correlate in shape, thus maintaining a constant cross-section in conduit 22.

Incoming liquid coolant 49 from conduits 24 flows over the curved heat exchange surfaces 12. The velocity of liquid flow over curved heat exchange surface 12 is in the turbulant region for efficient heat transfer. In flowing over concave curved heat exchange surface 12, a pressure gradient, having a component perpendicular to the heat exchange surface, is created in the liquid by a centrifugal force that is proportional to the square of the velocity of the coolant with respect to the curved surface. This pressure gradient more readily removes nucleate bubbles, thereby improving cooling efficiency as described in the aforementioned Iversen patents.

As described in the aformentioned Iversen patents, heat exchange may also be enhanced by nucleating, generally site cavities, generally indicated as 13A of optimum dimensions and spacing formed on the heat exchange surface such that maximum heat flux removal is achieved without encountering the destructive condition of film boiling. Cavity dimensions may range from 0.002 mm to 0.2 mm and spacing between cavities on the heat exchange surface may range from 0.03 mm to 3 mm. This specified geometry of nucleating cavity dimensions and spacing between cavities may be achieved chemically by chemical milling, electronically by lasers or electron beams, or mechanically by drilling, hobbing, etc.

As also described in the aforementioned Iversen patents, heat transfer may be further enchanced by breaking up a viscous sublayer formed in the coolant proximate to the heat exchange surface. Roughness elements, generally indicated at 13B e.g., truncated cones, that range in height from about 0.3 times the thickness of the viscous sublayer to about several times the height of the combined thickness of the viscous sublayer and on adjacent transition zone are provided on the heat transfer surface. In general, the height of the truncated cone, ranges from 0.0001" to about 0.008". If desired cavities 13A may be disposed on the truncated cones 13B.

As described in the forementioned Whitaker and Iversen patent, the inside surfaces of the cavities serving as nucleating sites and outer surface of the truncated cones may be further prepared with micro cavities, preferably re-entrant, with dimensions generally in the range of $10^{-4}$ to $10^{-2}$ mm. Micro cavities serve as permanent vapor traps that remain in equilibrium with the liquid under all conditions, including those of lowest temperature and highest pressure, and serve as the initial nucleate boiling site until the larger cavities commence nucleate boiling. Thus, full scale nucleate boiling becomes a two-step affair, with initial nucleate boiling taking place at the trapped vapor sites, and then in the larger cavities when sufficient vapor has been accumulated. Micro cavities may be created by judicious selection of diamond (or other cutting material) particle size which is embedded in the drill bit. With the laser, reactive vapors or gases may be introduced which react with the chill wheel material to create the desired pitting effect.

Another method of obtaining a surface with crevices for forming nucleate bubbles is the use of a thin porous metal layer adherent to the wheel at the heat exchange surface. Relatively uniform pore size can be obtained by fabricating the porous structure from metal powders with a narrow range of particle sizes. Methods, such as described in U.S. Pat. No. 3,433,632, are well suited to providing the desired porous metal structure.

After passing over heat exchange surface 12, the coolant 49 enters discharge conduit 26. To further reduce coolant pressure drops, multiple input conduits 24 may be connected in parallel. Likewise, output conduits 26 may be connected in parallel by suitable ducting (not shown). In the nucleate boiling regime, the heat exchange surface 12 will operate at the boiling temperature of the coolant, i.e., a constant temperature surface.

Gambill and Greene demonstrated heat transfer of $55X10^6$ BTU/hr-ft$^2$ (17,400 w/cm$^2$) using swirl flow cooling. Therefore, even a conservatively designed chill wheel using the present invention will have a heat transfer capability greater than the heat load being delivered by the molten metal solidifying on the chill surface. Thus, more efficient and better performance chill wheel designs are made practicable and a substantial percentage of the chill surface can be utilized for making amorphous materials. This results in substantially higher throughput of material for a given chill wheel geometry and thus lower cost of operation.

The ability to remove heat as fast as it is delivered combined with a short heat flow path assures that a low chill surface temperature may be maintained continuously. This can then relax and in some instances eliminate the velocity differential between the chill wheel surface and the molten metal jet that is often required in prior art devices to provide adequate heat transfer. The present invention permits the velocity of the molten metal jet to be equal to, greater than, or less than the velocity of the chill surface whereby distortions in the resultant filaments can be minimized or avoided. In this manner, wheels, or rollers of substantial width may be made, with the molten metal being fed through a slot of suitable length.

Structural rigidity of the chill wheel is enhanced by the fluted construction of the chill wheel's heat exchange walls. Furthermore, the wheel can be formed of dispersion-hardened coppers with high thermal conductivity. Examples of hardening agents are silver, beryllium, zirconium or alumina. The use of 0.15% alumina-oxygen free copper is preferred, as it offers over 90% of the thermal conductivity of pure oxygen free copper (OFHC) while being extremely strong to temperatures exceeding 1500° F.

Minimum chill all thickness 11 may be 1mm and possibly as small as ½ mm, depending upon chill wheel dimensions, rotations per minute (RPM) and materials of construction.

Figure 2:
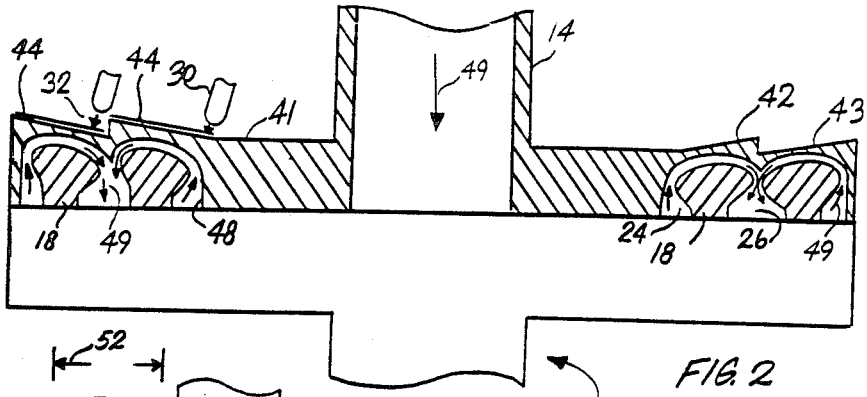
FIG. 2 is a cross-sectional view of the present invention illustrating a rotating radial chill surface with stepped chill surfaces constructed at an incline with the radial surface.

FIG. 2 illustrates a further preferred embodiment of the present invention wherein the chill surface 42, 43 of chill wheel 40 comprises the external radial surface 41. Chill wheel 40 is rotatably attached to rotating hollow shaft 14 which also serves as an input and exhaust conduit for liquid coolant 49. Radial surface 41 may be provided with concave curved or sloped surfaces 42, 43 such that as molten metal filament 44 solidifies, it is kept in prolonged contact with chill surface 42 or 43 by virtue of a component of centrifugal force, the component being proportional to the slope of surface 42. The interior radial surface 48 of chill wheel 40 is prepared with multiple curved heat exchange surfaces 12 with coolant input conduits 24 and output conduits 26 being fed in parallel by suitable ducting (not shown). A pressure gradient is generated by virtue of the centrifugal force which arises form flow of the coolant 49 over the concave curved surface 12. Convex curved surface 20 of flow diverters 18 serve to provide the desired liquid flow characteristics as in FIG. 1. The pressure gradient generated on concave curved heat exchange surface 12 improves heat transfer in the same manner as described in conjunction with FIG. 1.

Figure 3:
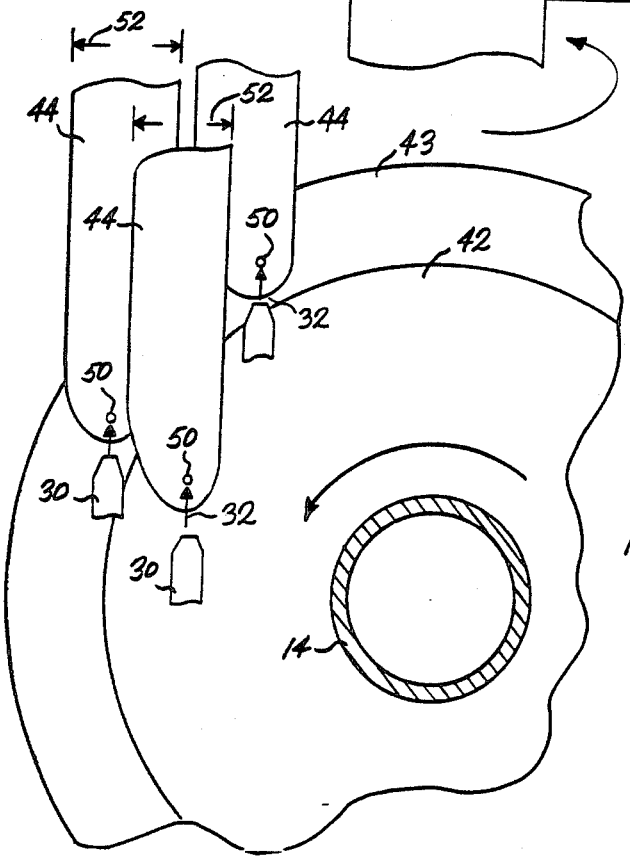
FIG. 3 is a partial vertical view of FIG. 2.

The radial chill surface 41 of the embodiment of FIG. 2 is particularly advantageous in that it facilitates simultaneous generation of multiple filaments. Referring to FIG. 3, multiple crucibles 30 eject molten metal jets 32 which strike chill surface 41 at point 50 (sometimes referred to as impact point 50). Crucibles 30 may be spaced circumferentially around the chill wheel, thus generating multiple filaments 44 instead of a single filament. Since the present invention has a heat flux removal capability, greater than that delivered by the molten metal, as previously discussed, the entire chill surface may be made use of for the generation of filaments.

Crucibles 30 are positioned to drive jets of metal 32 to impact points 50 on each sloped or curved radial chill surface 42, 43. Chill surfaces 42, 43 are suitably terraced or stepped by at least the thickness of the filament being generated. In this manner, as the molten metal strikes the jet impact point 50, it spreads out into filament 44 of width 52. By being terraced, filaments from chill surfaces 42 and 43 may overlay without interfering with each other as they leave the wheel impelled by centrifugal force. Impact point 50 of metal jet 32 may be on flat radial surface, thus permitting optimum flow before being forced by a component of centrifugal force against concave curved or sloped surfaces 42 and 43. Impact point 50 may have a negative slope to minimize the forces that initially spread the molten metal.

Two stepped or terraced chill surfaces 42, 43, are shown in the embodiment of FIGS. 2 and 3. However, additional surfaces may be incorporated depending upon the filaments being manufactured. A further alternative is to keep the radial surface flat, without the concave curved or sloped surface 42, 43. Multiple stepping or terracing of the outer radial surface may also be employed.

The ability to provide a low chill surface temperature is dependent on the ability to rapidly remove heat from the liquid cooled heat exchange surfaces 12. The heat transfer equation is given by $T=To+q(b/k)$, where To is the boiling temperature of the coolant at the heat exchange surface 12, b is the thickness of the chill wall, k is the thermal conductivity and q the heat flux. It is seen that the thickness b and thermal conductivity K can be offsetting parameters. That is, a lower thermal conductivity k can be offset by a thinner chill wall thickness b. Thus, the chill surface temperature is seen to be linearly dependent on the thickness of the chill wall 11, i.e., the portion of the wheel interposed between the chill surface (16, FIG. 1; 41 FIG. 2, 3) and the heat exchange surface 12.

In the prior art the heat removal rate of the chill wheel ( e.g. $3\times10^4$ BTU/hr-ft$^2$), is substantially less than the heat input rate; a thick chill wall (e.g. 6.3 mm–12 mm) is often used or may be needed to permit lateral diffusion of heat. However, with a highly efficient heat transfer surface such as the present invention where, in the heat removal rate capability, (e.g. up to $55\times10^6$ BTU/hr-ft$^2$), is much greater than the heat input rate of (e.g.$2\times10^6$ BTU/hr-ft$^2$) heat flow can be totally radial and, thus, a thin wall may be used. A chill wall thickness of 1 mm may be used.

In accordance with one aspect of the present invention, the thin chill wall tends to result in a relatively small temperature increase at the chill surface over the coolant boiling temperature. Thus, not only does lower chill surface temperature result, but the lower temperature differential between the surrounding cold chill surface metal presents less chance of mechanical distortion or warpage.

The efficient liquid cooling of the present invention lends itself to incorporation into an evacuated chamber. The production of amorphous materials in a vacuum eliminates, among others, the problems of oxidation and gas inclusion. In addition, when fabricating high melting point amorphous metals or ceramics, a high thermal conductivity material with a high melting point is desirable to prevent reaction with or pitting of the chill wheel. Ideal chill wheel materials would be molybdenum or tungsten which have thermal conductivities 35% and 45% that of copper. By comparison, type 304 stainless steel, which has been suggested for use as a chill wheel, has a thermal conductivity that is only about 5% that of copper. For a given chill wall thickness and heat flux, the surface temperature of a stainless steel chill wheel would be 7 times higher than molybdenum and 9 times higher than tungsten, thus reducing the quench rate. Also, the melting point of type 304 stainless steel is 1427° C. as compared to 2617° C. for molybdenum and 3410° C. for tungsten, thus making it less suitable for high melting point metal alloys, ceramic or other materials. High thermal conductivity ceramics may be deposited on a molybdenum or other suitable metal chill wheel, or a wheel made of ceramic may be used. Examples of suitable ceramics include beryllia, alumina and silicon carbide.

In the manufacture of finished articles, it is often standard procedure to convert amorphous metal filaments to powder form. To simplify and to lower the costs of conversion, it would be desirable to fabricate the amorphous metal filaments in short and approximately equal lengths. This has been accomplished in the prior art by providing a non-wetting surface or gaps or depressions on the chill surface to separate the material to prescribed dimensions.

Figure 4:
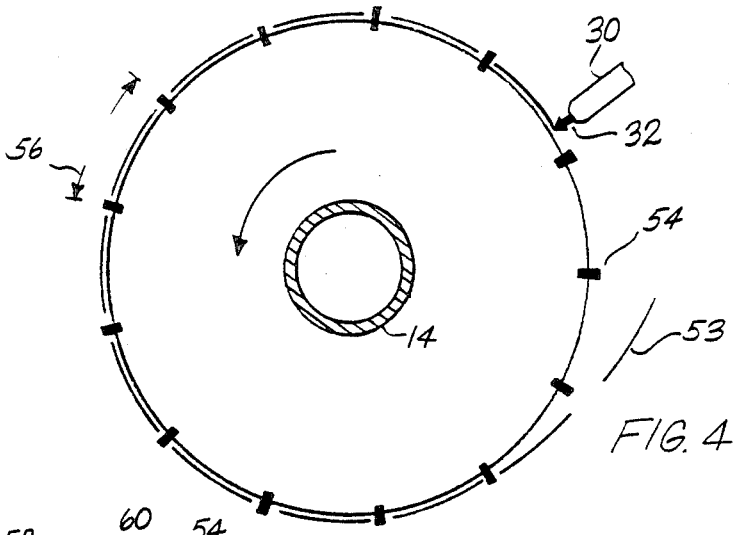
FIG. 4 is a side elevation view of a circumferential chill wheel surface fitted with protrusions to segment the filament material and retain it in prolonged contact with the chill surface.
Figure 5:
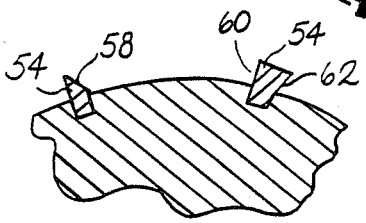
FIG. 5 is a partial cross-sectional view of the circumferential chill wheel of FIG. 4 illustrating the various geometries of the protrusions.
Figure 6:
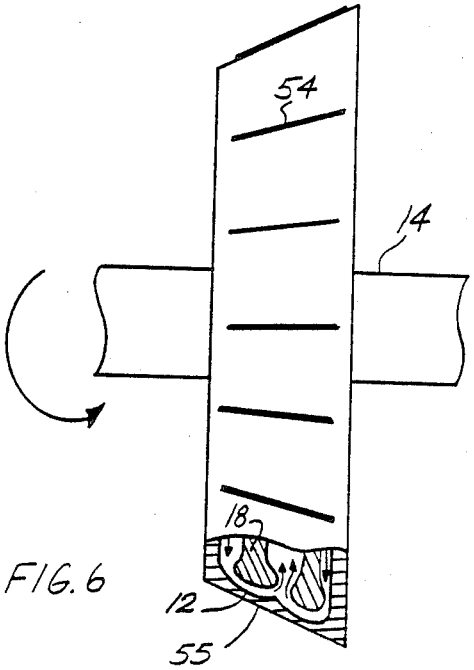
FIG. 6 is a side elevation view, with partial cut-away, of a chill wheel with the circumferential chill surface inclined with respect to the radial surface, said chill surface also being equipped with protrusions.

Referring now to FIGS. 4–6, a further embodiment of the present invention employs periodic circumferentially-spaced protrusions 54 extending the width of the chill wheel or roll, to fabricate short lengths 53 of amorphous filaments which may then be easily mechanically comminuted to powders of desirable size ranges and, in addition, retain the filament against the chill wheel circumference for a predetermined percentage of one rotation, thereby assuring a complete quench of the metal filament. This has special significance for metal alloys with poor thermal conductivity or for filaments of greater thickness.

The retention of filament segments 53 against the chill surface for a predetermined fraction of a rotation, ensures a complete quench prior to being thrown free by centrifugal force from the circumferential surface of the chill wheel. Protrusions 54 are preferentially thin elements made of a stiff, high thermal conductivity metal, such as molybdenum or tungsten, or ceramic, such as silicon carbide or beryllium oxide. The time of retention of the amorphous filament segment 53 against the chill wheel may be regulated by the arc length 56 of the metal filament and the geometry of the protrusions. Examples of protrusion geometry include tapered 58, radial 60 and undercut 62, each providing increasingly greater retention. It may be further desirable to select different protrusion geometries at each end of the filament, thereby better controlling the centrifugal "throw off" characteristics of the chill wheel.

Referring now to FIG. 6, a further modification is to slant the circumferential chill surface 55 with respect to the axis of rotation while substantially retaining the internal liquid heat exchange geometry as described for FIG. 1. In this manner, continuous helical filaments may be fabricated. The corresponding slanted surface of a second, substantially identical, counter rotating (with respect to the first wheel) chill wheel may be brought into close proximity to the first wheel to obtain a dual chill wheel apparatus also suitable for manufacturing helically-shaped amorphous filaments.

A further preferred embodiment of the slanted chill surface 55 of FIG. 6 would be to provide protrusions 54 as described for FIG. 4. The slanted surface 55 provides further filament segment 53 retention characteristics as may arise from sliding along slanted surface 55 prior to release by centrifugal force. The surface geometry, 58, 60, 62 of protrusions 54, also plays a role in the retention characteristics of filament segments 53 on slanted chill surface 55.

Protrusions 54 may also be mounted on radial chill surfaces 42, 43 (FIGS. 2,3). Radial alignment of protrusions 54 spaced equally around the circumference of chill surfaces 42, 43 is a preferred embodiment. Orientations of protrusions 54 other than radial may be desirable in order, for example, to permit a better and more uniform spread of the liquid metal at impact point 50, or to increase or decrease retention of the filament segment 53 against the chill surface. Changes in filament 53 retention may be accomplished by angling protrusion 54 toward the direction of rotation with increasing radius or against the direction of rotation. In this embodiment, a crucible geometry ejecting the liquid metal in a long narrow slit, approximately the width of protrusion 54, is desirable, thus making a more uniform filament.

A further method for prolonging metal retention on the wheel is by varying the angular velocity of a given wheel geometry. The angular velocity and associated centrifugal force is varied such that, below a critical value, the alloy sticks to the wheel, and above it, is thrown free. Thus, the time of adhesion, i.e., dwell time, of the metal to the wheel can be controlled by operation at selected angular velocities above the critical value. The desired adhesion time is dictated by the properties of the quenched material, i.e., thermal conductivity, specific heat, coefficient of expansion relative to the chill wheel, etc., and the thickness. In general, the maximum dwell time should be less than one wheel revolution. However, a method whereby adhesion time may be extended to a number of wheel revolutions to ensure proper quenching of thick, high specific heat, low thermal conductivity, etc., material is to operate the wheel at an angular velocity below the critical angular velocity, thereby causing the metal to adhere and rotate with the wheel. For optimum wheel usage, the quenched metal on the wheel occupies approximately the circumference of the wheel. The foregoing assumes that metal contraction during cooling does not break it free. A solution to this is to have a slight overlap of metal on the wheel, there being a relatively weak bond between the cooler material of the initial edge laid down and the molten material deposited at the start of the succeeding revolution. The substantially single circumference of quenched material may be removed form the wheel by either increasing the angular velocity of the wheel above the critical value to throw the quenched material free, or to use mechanical, energy beam (laser), or other means to remove it. By optimizing the material adhesion time to the chill wheel, lower metal or material temperatures are achieved, thus providing improved microcrystalline or amorphous properties.

Figure 6A:
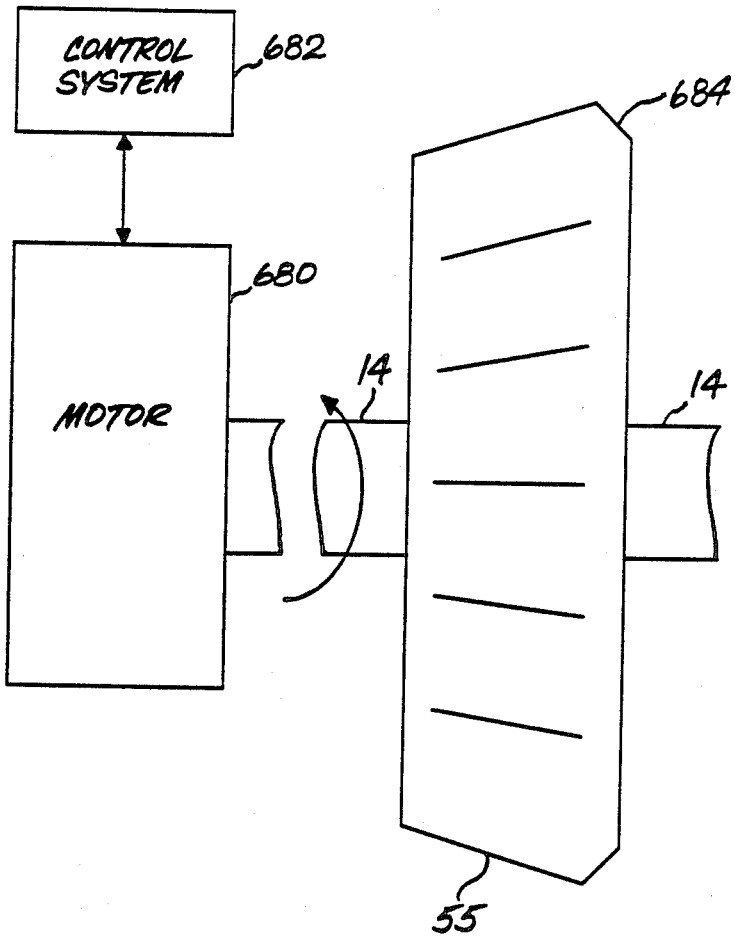
FIG. 6A is a block schematic of an angular velocity control system.

Referring to FIG. 6A, control of the angular velocity can be effected by techniques well known in the art. For example, shaft 14 may be coupled to a variable speed motor 680, controllably driven by periodically varying signals from a suitable control system 682. Alternatively, more sophisticated speed control systems, such as computer or microprocessor based systems can be utilized.

A further method whereby adherence of the metal to the wheel may be prolonged and which may be combined with the foregoing wheel speed control is by beveling the peripheral edges of the wheels, generally indicated at 684. The bevel may be linear or curved. The molten metal is caused to flow on the chill wheel periphery and also on the beveled surfaces. As the molten metal cools, it shrinks, and as it shrinks in the direction across the width of the chill wheel, it locks onto the wheel. The force with which the amorphous or microcrystalline material adheres to the chill wheel is determined by the length and the angle of the slope of the bevel. The greater the angle, the greater the force.

Figure 7:
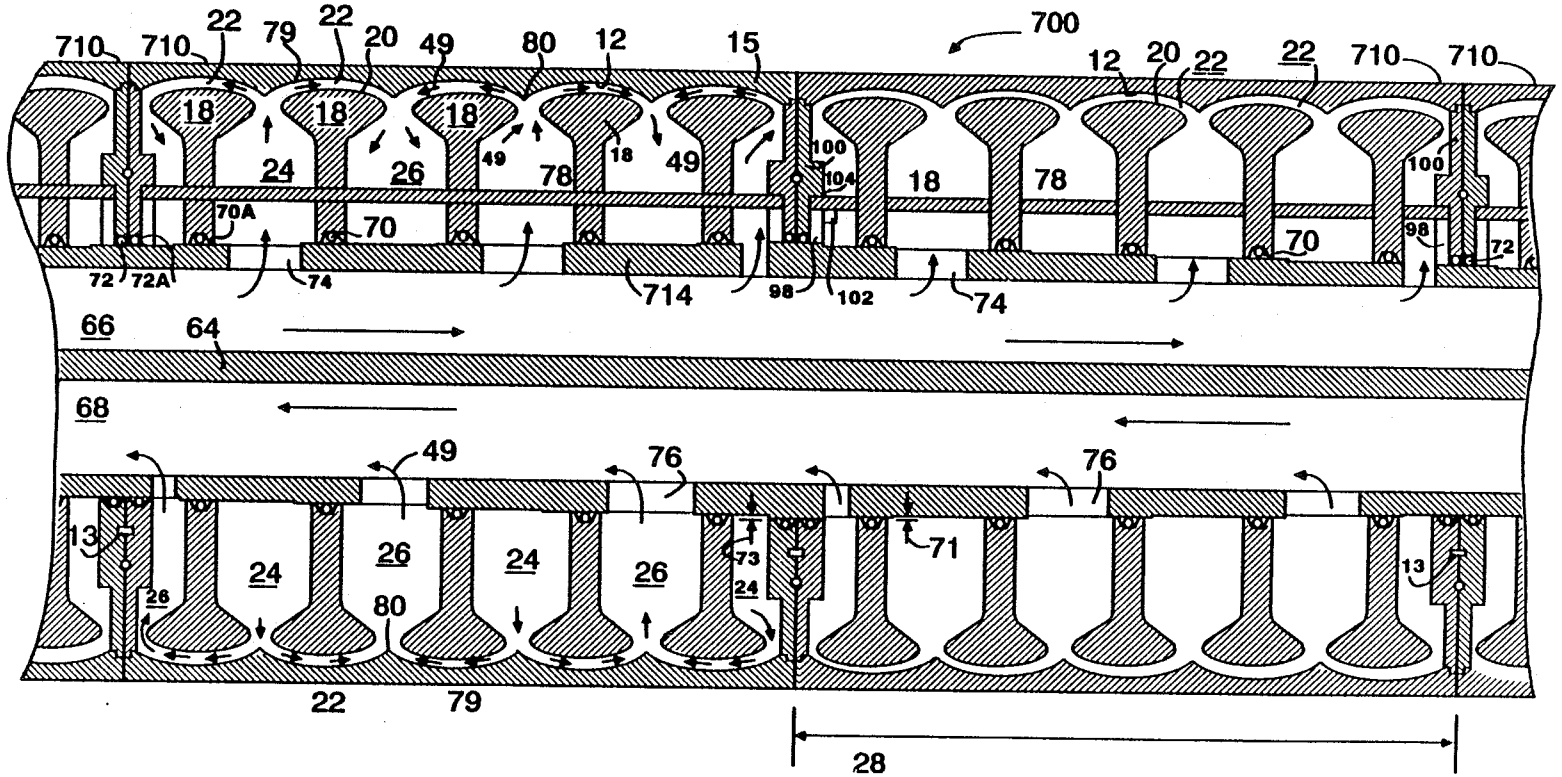
FIG. 7 is a mid-section view of a modular spin chill casting roller in accordance with the present invention.
Figure 8:
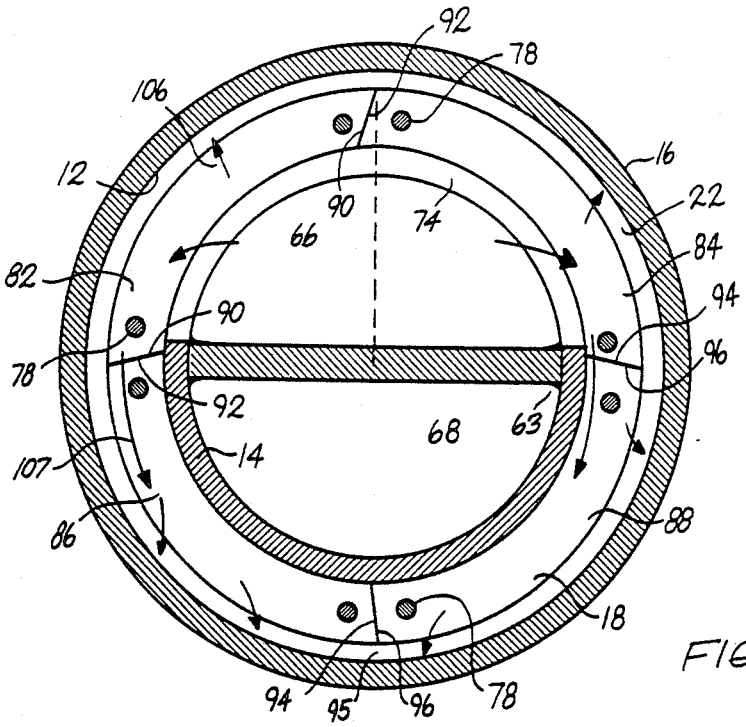
FIG. 8 is a radial section view of the embodiment of FIG. 7.

Referring now to FIGS. 7 and 8, a chill casting roller 700 in accordance with the present invention of modular construction and extended length is described. Two or more wheel (or roller) segments 710 are mounted in abutting relationship on hollow rotating shaft 714. Each roller segment 710 includes an outer cylindrical shell 15. The outer surface of shell 15 acts as the chill surface of the roller. The internal surface of shell 15 comprises the liquid cooled heat exchange surfaces 12. Heat exchange surfaces 12 are preferably concave curved in the form of flutes 81 with cusps 80. Multiple adjacent curved surfaces 12 may be provided to provide a chill surface width 28 of arbitrary dimensions. A typical construction of the fluted heat exchange surface might use a 2-inch radius of curvature for the flute and a 2 mm height of cusp to flute mid-point. This yields a flute chord distance of 1.14 inches. Thus, the 5 flutes shown would provide a roller width 28 of slightly under 6 inches. The multiple curved surfaces 12 of outer cylinder 15 may be machined simultaneously and at low cost by precision gang mounting shaped multiple cutters on a shaft. As cylinder 15 is rotated slowly, the rapidly rotating ganged cutter assembly cuts all curved surfaces 12 simultaneously. The shaft axis of the cutter assembly and cylinder 15, though displaced from each other, would be parallel during cutting operations.

As will be discussed, each roller segment 710 also includes a set of flow diverters 18, contained within shell 15, to form respective coolant conduits. The relative disposition of diverters 18 and shell 15 is maintained by a plurality of axial rods 78 (only one shown in FIG. 7 for ease of illustration) cooperating with respective sidewalls 100. Pins 13 may be used to couple adjacent rollers 10. The end rollers 10 are coupled by pins 13 or other means to end plates (not shown) which are fastened to shaft 14, rotatably coupling shaft 14 to rollers 10. The end plates suitably also provide compression to maintain adjacent rollers 10 in intimate abutting relationship.

Shaft 714 contains a longitudinally disposed septum 64 having edges running adjacent to the interior wall of shaft 714 at point generally indicated at 63 (FIG. 8). Septum 64 divides the interior of shaft 14 into two conduits, one for incoming coolant 66 and the other for discharge coolant 68. The dealing relationship of septum 64 to the interior wall of hollow shaft 14 at point 63 need only be sufficient to keep leakage of coolant from the incoming conduit 66 into the outgoing coolant conduit 68 within acceptable limits. Accordingly, system 64 may be force (press) fit, or spot welded in position within shaft 714.

Respective flow diverters 18 are, as will be explained, disposed about the outside diameter of shaft 714, extending radially therefrom. Flow diverters 18, when assembled, extend completely around shaft 714, and are generally dish-like in shape with a bulbous end portion presenting convex curved surface 20 disposed in close proximity to concave heat exchange surface 12. In cooperation with heat exchange surface 12, convex surfaces 20 form conduit 22 to precisely control the flow of liquid coolant over heat exchange surface 12. In general, the slopes of convex surfaces 20 parallel concave heat exchange surface 12 to maintain a constant cross-section in conduit 22.

Flow diverter 18 cooperates to form respective input conduits 24 and output conduits 26. Respective circumferentially drilled holes or semi-circumferential slots 74 (sometimes referred to as input slots 74) are formed in shaft 714, communicating with input conduit 66, and disposed between alternate pairs of flow diverters 18. Similar respective circumferentially drilled holes or semi-circumferential slots 76 (sometimes referred to as discharge slots 76) are formed in the opposing side of shaft 714, communicating with discharge conduit 68, disposed between the offset (staggered) alternate pairs of flow diverters 18, as is best seen in FIG. 8. Circumferential slots 74 and 76 extend slightly less than 180° about shaft 714. In some circumstances, shaft rigidity may be improved by use of a circumferential sequence of individual holes rather than a continuous slot.

In general, referring to FIGS. 7 and 8, coolant liquid 49 is admitted through inlet slot 74 into an inlet conduit 24 formed between adjacent flow diverters 18 (or between a diverter and section end panel 100). Coolant flow then proceeds radially outward (indicated generally by arrow 106 in FIG. 8) and circumferentially (in the direction of arrow 107) from both edges of slot 74 towards a point 95 (FIG. 8) on septum 18 opposite the center of slot 74. To ensure proper flow and distribution characteristics of the coolant, flow diverters (shown schematically in FIG. 9 as 108) may be provided. The coolant then flows through the respective conduits 22 formed by the convex surface 20 of diverters 18 and heat exchange surface 12, and through the nucleate boiling mechanism removes heat from surface 12. The coolant then flows radially inwardly (and circumferentially) through discharge channel 26 formed between one of the diverters 18 and the next adjacent diverter 18 (or an end wall), and exits through a discharge slot 76 into discharge conduit 68.

Incoming liquid coolant 49 from conduits 24 flows over the curved heat exchange surfaces 12. The velocity of liquid flow over curved heat exchange surface 12 is in the turbulant region for efficient heat transfer. In flowing over concave heat exchange surface 12, a pressure gradient, having a component perpendicular to the heat exchange surface, is created in the liquid by a centrifugal force that is proportional to the square of the velocity of the coolant with respect to the curved surface. This pressure gradient, in a sub-cooled liquid, more readily removes nucleate bubbles, thereby improving cooling efficiency. In addition, heat exchange surfaces 12 may also include roughness elements, cavities, and microcavities to break up viscous sublayers in the coolant and to facilitate and control generation of nucleate bubbles. After passing over heat exchange surface 12, the coolant 49 enters discharge conduit 26.

Roller segments 710 are assembled by first constructing a subassembly comprising shell 15, diverters 18 and side walls 100, then installing the subassembly on shaft 714. In general, when assembled, the outside diameter (OD) of flow diverters 18 is larger than the inside diameter 12 and, thus, cannot be placed in position as an integral circular element. Therefore, in order to mount flow diverters 18 within shell 15, flow diverters 18 are segmented and the corresponding segments of the respective diverters 18 connected to form diverter segment subassemblies. In the embodiment of FIG. 8, the flow diverters 18 are segmented into four parts 82, 84, 86 and 88. Each flow diverter segment 82 is interconnected, disposed in precise relationship on axial shafts 78 (FIGS. 7, 8) by brazing or other mounting techniques. Diverter segments 84, 86 and 88 are likewise interconnected into respective subassemblies.

Figure 7A:
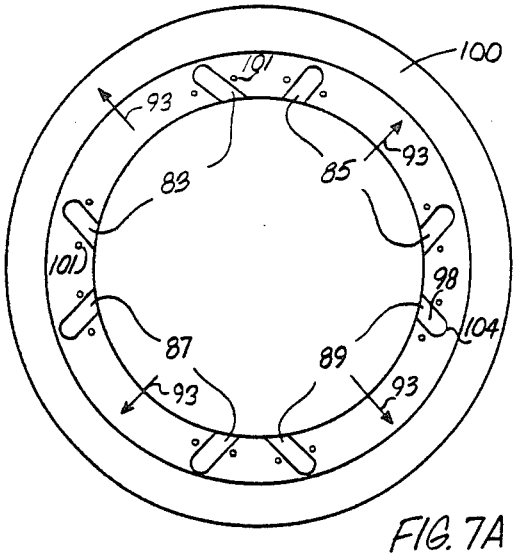
FIG. 7A is an end view of a section sidewall in the modular roller of FIG. 7.

One side wall 100 is installed at one end of shell 15, fastened in a leak-tight manner, such as, for example, by brazing. As shown in FIG. 7A, side wall 100 includes a plurality of radially aligned slots 98, of a predetermined depth and width commensurate with the length and diameter of rod 78, respectively, and extending to the inner diameter of side wall 100. Slots 98 are disposed to receive and define the proper disposition of rod 78. The rods 78 of the subassembly of segments 82, 84, 86 and 88 are received in sets of slots designed 83, 85, 87 and 89, respectively (FIG. 7A). A groove stop 104 is disposed at the inner terminus of slots 98. The respective individual subassembly of diverter segment 82 is then inserted into the interior of shell 15. The end of rods 78 is received in the inner portions of slots 98, and then brought into position by sliding rods 78 radially upward in slots 98. The individual subassemblies of segments 84, 86 and 88 are then similarly installed in sequence.

To enable insertion of the subsequent diverter subassemblies, the edges 90 of segments 82 are inwardly angled, formed at an angle 91 from radial. The corresponding edge surfaces 92 of segments 84 and 86 are correspondingly outwardly angled such that when the subassemblies are inserted, edges 90 and 92 mate in flush relationship. In order for subassemblies of segments 84 and 86 to slide radially up slot 98, the chord distances from a radius in the center of segments 84 and 86 to the outside diameter at edges 92 must be equal to or less than the chord distances to the inside diameter at edges 92. This avoids an interference as the outside diameter of segments 84 and 86 pass the inside diameter of segments 82 as the subassemblies of segments 84 and 86 slide radially upward in slots 98 in side walls 100. Alternatively, if slots 98 are disposed at an angle to the radius, whereby faces 90 and 92 approach each other in a nonradial motion, faces 90 and 92 may be made radial; the unoccupied area of the shell inner allotted to the subassembly of segments 88 enables subassemblies 84 and 86 to permit such an alternative insertion technique. However, in either event, faces 94 of segments 84 and 86 must be inwardly angled (in the manner previously discussed with respect to faces 90 of segments 82) to accommodate the insertion of the last subassembly to be inserted, subassembly 88.

After the respective diverter subassemblies have been installed in shell 15, the second side wall 100 is secured, in any suitable leaktight manner, to shell 15. A locking mechanism 102 is suitably provided to maintain rods 78 against groove stop 104, thereby maintaining the precise geometry of conduit 22. Locking mechanism 102 (FIGS. 7, 7A) may be a small plate fastened to side wall 100 by screws at threaded holes 101 located on each side of each slots 98.

Respective "O" rings 70, 72 are provided to prevent substantial leakage between input and output conduits and external leakage, respectively. Grooves 70A, 72A are provided, of dimensions corresponding to O rings 70, 72, in the bottom surfaces of diverters 18 and side walls 100. After the shell-diverter subassembly has been constructed, O rings 70, 72 are disposed and retained in grooves 70A, 72A. If desired, retention of O rings 70, and, in some cases O rings 72, in grooves 70A, 72A, can be facilitated by application of a relatively viscous lubricant. O rings 72 prevent external leakage of coolant and, therefore, should be liquid-tight. However, the O ring seals at 70 separate incoming coolant flow from the discharge flow and, thus, need only keep, within acceptable limits, the leakage of coolant from the incoming coolant conduits 24 into the discharge conduits 26.

The outside diameter (OD) of shaft 14 may be stepped to facilitate installation of the subassembly on shaft 14. Increasing the OD of shaft 14 gradually, or in steps (as shown in FIG. 7) enables the sealing elastomer O rings 70, 72 to slide relatively long lengths along the shaft outside diameter under minimal compression, thereby minimizing friction and possible damage. As will be discussed, shaft 714 may also be sectioned into interengaging lengths to facilitate installation of the shell-diverter assembly.

Figure 7B:
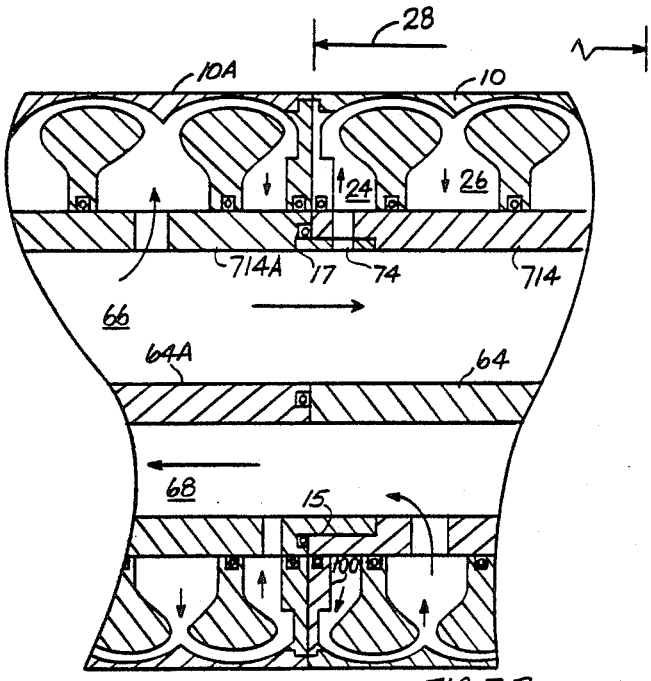
FIG. 7B is a schematic illustration of a modular spin chill casting roller utilizing threaded sections of shaft.

Any number of respective completed wheel section assemblies 10, including shell 15, shaft 14 and septum 64, may be interengaged to form a roller assembly of arbitrary length. The respective assemblies 10 may be joined by screwing or bolting them together. For example, as shown in FIG. 7B, abutting rotting hollow shafts 714, 714A may be threaded at overlapping alignment joint 15. Slots 74 are provided as required in the threaded section 15 to provide coolant flow into conduits 24 or 26, as necessary. Thus, sections 10 and 10A may be joined by screwing sections 10 and 10A together at threaded sections 15. O ring 17 or other sealing means are provided a the junction of shaft segments 714 and 714A. An O ring 19 may also be provided at the junction of abutting septum elements 64, 64A. However, seal 19 need only keep coolant leakage between input 66 and output 68 conduits within acceptable limits and need not be liquid-tight. With a suitable close abutment (joining) of septum elements 64, 64A, seal 19 may not be required.

Figure 7C:
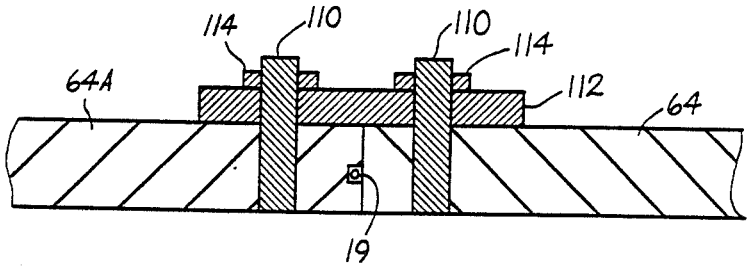
FIG. 7C is a sectional view of a system interlock.

Alternatively, rather than overlapping joints 15 of tube segments 714 and 714A, sections 10 and 10A may be slid into abutting relationship with each other, to cooperate in a pressure fit, and abutting sections of septum 64 (64, 64A) interlocked. For example, as shown in FIG. 7C, threaded pins 110 may be mounted in septum elements 64, 64A. A plate 112, having holes to precisely fit pins 110, is inserted to maintain sections 10 and 10A in intimate abutting relationship. Nuts 114 hold plate 112 firmly against septum elements 64, 64A. O rings 19 are provided as required.

It should be noted that fabrication of shell 15 separately from the other elements of roller 10 and mechanically coupled to the other elements through the connection to side walls 100 roller 10 provides substantially economies of manufacture and maintenance. Only outer cylindrical shell 15 or roller 10 is subject to particular wear. The roller may be maintained by sliding roller assembly 10 off of shaft 14. Side walls 100 may be removed or machined off of shell 15 and typically may be reused. The subassemblies of diverters 82, 84, 86 and 88 may then be removed and similarly may be reused.

Figure 9:
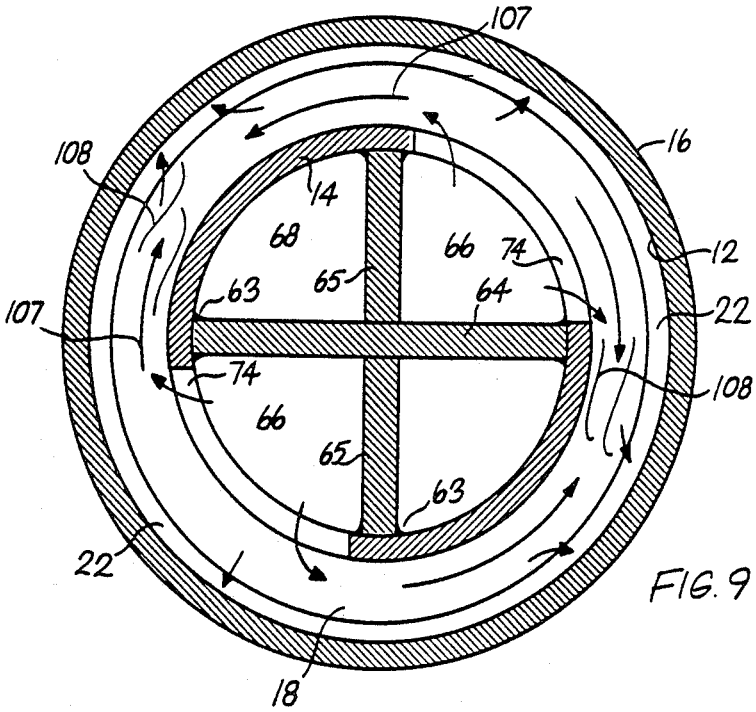
FIG. 9 is a radial section view of an alternative embodiment of a spin chill casting roller.

If desired, control of circumferential coolant flow characteristics can be improved by dividing the inside of shaft 714 into a plurality of separate inlet and discharge conduits, e.g., 2 each, as shown in FIG. 9. This has the advantage in that the distance of circumferential flow (arrow 107) is decreased, e.g., halved; 45° travel instead of 90° from each edge of slots 74.

A septum providing two sets of inlet and discharge conduits may be formed by welding, brazing or otherwise fastening a septum element 65 to septum 64 at approximately right angles. Septum 65 need only be sealed (intersections 63 in FIG. 9) to the ID of shaft 14 and to septum 64 in such manner that leakage between coolant input 66 and output 68 conduits is within acceptable limits. Septum 65 also stiffens shaft 14.

The embodiment of the present invention shown in FIG. 7 is particularly advantageous. The limited length of the individual roller assemblies 10 and absence of a rigid fixed connection between the end walls 100 of roller 10 and shaft 14 enables axial movement of the roller 10 relative to shaft 14, thus minimizing "crowning" during heating of the roller by molten metal. Moreover, distortion due to heating and similar phenomena are minimal in view of the efficient removal of heat combined with only minor temperature variations along the chill surface. Further, only a low pressure drop exists through conduit 22 containing heat transfer surface 12. Since all conduits 22 are in parallel, the total pressure drop is approximately equal to that across one conduit 22. With a low pressure drop in the vicinity of O ring seals 70 and 72, seal reliability is enhanced. This seal reliability is especially critical with O ring seal 72 inasmuch as it seals against the outside environment, be it vacuum or atmosphere.

It is seen in FIGS. 7, 8 and 9 that the entire chill roller assembly rotates as a unit. Thus, the coolant flowing through the roller assembly is caused to rotate. To enhance the efficiency of the described chill roller, a turbine structure (not shown) may be attached to rotating hollow shaft 14 at the discharge end. The turbine extracts the rotational component of energy from the coolant and returns it to the rotating shaft 714, thereby reducing power requirements.

It will be understood that the above description is of preferred exemplary embodiments of the present invention, and that the invention is not limited to the specific forms shown. Modification may be made in the design and arrangement of the elements without departing from the scope of the invention as expressed in the appended claims.

I claim:

1. In a chill block melt spinning apparatus of the type including a rotatable substrate wheel having a chill surface disposed to surface cooperating with said chill surface, and means for providing a flow of coolant liquid to remove heat from said heat exchange surface by formation of nucleate vapor bubbles on said heat exchange surface, the improvement wherein said apparatus includes:

means, disposed on said heat exchange surface for forming pressure gradients in said liquid having a component perpendicular to said heat exchange surface without substantially impeding the relative velocity between said heat exchange surface and said liquid, said component having a magnitude directly proportional to the square of the relative velocity between said heat exchange surface and said liquid, to facilitate removal of said nucleate bubbles.

2. In the apparatus of claim 1, the further improvement wherein said casting surface is comprised of tungsten or molybdenum.

3. In the apparatus of claim 1, the further improvement wherein said casting surface is made from dispersion-hardened copper containing 0.05% to 2% alumina.

4. The apparatus of claim 1 wherein said substrate wheel includes first and second generally opposed surfaces and a peripheral edge surface interconnecting said generally opposed surfaces, said peripheral edge surface lying substantially normal of the axis of rotation of said wheel, said chill surface being disposed on said peripheral edge surface.

5. The apparatus of of claim 4, wherein said substrate wheel is hollow, and said heat exchange surface is disposed on the interior of said peripheral edge underlying said chill surface and includes at least one periodic curve across substantially the width of said chill surface and extending along the circumference of said peripheral edge; and said apparatus further includes a liquid coolant diverter disposed within said substrate wheel interior in close proximity to said heat exchange surface to provide predetermined liquid flow conditions at said heat exchange surface.

6. The apparatus of claim 1 wherein said substrate wheel includes first and second major surfaces and a peripheral surface interconnecting said major surface, said major surfaces lying substantially normal to the axis of rotation of said wheel, and said chill surface is disposed on said first major surface.

7. The apparatus of of claim 6, wherein said substrate wheel is hollow, and said heat exchange surface is disposed on the interior of said first major surface underlying said chill surface, and includes at least one adjacent periodic curve across substantially the width of the chill surface and extending along the circumference of said first major surface; and said apparatus further includes a liquid coolant diverter disposed in close proximity to said heat exchange surface to provide predetermined liquid flow conditions at said heat exchange surface.

8. In the apparatus of claim 1, the further improvement wherein said heat exchange surface includes means disposed on said heat exchange surface for forming nucleate bubbles of predetermined size and distribution.

9. In the apparatus of claim 8, the further improvement wherein said means for forming nucleate bubbles comprises cavities having dimensions in the range of about 0.002 mm to about 0.2 mm, said cavities being spaced apart on said heat exchange surface at distances ranging from about 0.03 mm to about 3 mm.

10. In the apparatus of claim 9, the further improvement whereby the inside surface of said cavities are prepared with micro cavities, the dimensions of said micro cavities being in the range of about $10^{-4}$ mm to about $10^{-2}$ mm.

11. In the apparatus of claim 8, the further improvement wherein said heat exchange surface includes roughness elements having heights ranging from about 0.0001" to about 0.008" above said heat exchange surface.

12. In the apparatus of claim 11, the further improvement wherein said cavities comprise truncated cones whose bases are affixed to the heat exchange surface, said cones containing approximately centered cavities which are exposed to the liquid.

13. The apparatus of claim 1 wherein said apparatus further includes:

elements of predetermined geometry protruding from said chill surfaces, disposed thereon at predetermined distances.

14. The apparatus of claim 13 wherein said elements are formed of a high thermal conductivity material.

15. The apparatus of claim 14 wherein said elements are made of a material chosen from the group consisting of molybdenum, tungsten, silicon carbide and beryllium oxide.

16. In a chill block melt spinning apparatus of the type including a rotatable substrate wheel having a chill surface disposed to receive molten material, a heat exchange surface cooperating with said chill surface, and means for providing a flow of coolant liquid to remove heat from said heat exchange surface by formation of nucleate vapor bubbles on said heat exchange surface, the improvement wherein said apparatus includes:

means, disposed on said heat exchange surface, for forming nucleate bubbles of predetermined size and distribution to thereby increase heat flux.

17. The apparatus of claim 16 wherein said substrate wheel includes two generally opposed surface and a peripheral edge surface area interconnecting said generally opposed surfaces, said peripheral edge surface lying substantially normal to the axis of rotation of said wheel, and said chill surface is disposed on said peripheral edge surface.

18. The apparatus of claim 16 wherein said substrate wheel has two major surfaces and a peripheral edge surface interconnecting said major surfaces, said first major surface lying substantially normal to the axis of rotation of said wheel and said chill surface is disposed on first major surface.

19. In the apparatus of claim 18, the further improvement wherein said liquid coolant comprises a non-dielectric fluid.

20. In the apparatus of claim 16, the further improvement wherein said heat exchanger surface has intimately adherent thereto a thin porous metal layer.

21. In the apparatus of claim 20, the further improvement wherein said porous metal is of relatively uniform pore size.

22. In a chill block melt spinning apparatus for receipt of a molten material having an optimum heat flux threshold for cooling to a desired solid state, said apparatus of the type including a rotatable substrate wheel having a chill surface disposed to receive molten material, a heat exchange surface cooperating with said chill surface, and means for providing a flow of coolant liquid to remove heat from said heat exchange surface by formation of nucleate vapor bubbles on said heat exchange surface, the improvement wherein said apparatus includes:

means, cooperating with said heat exchange surface, for dissipating heat flux generated in said wheel by said molten material at a rate at least as great as said optimum heat flux threshold.

23. The apparatus of claim 22 wherein said means for dissipating comprises:

means, disposed on said heat exchange surface, for forming pressure gradients in said liquid having a component perpendicular to said heat exchange surface without substantially impeding the relative velocity between said heat exchange surface and said liquid, said component having a magnitude directly proportional to the square of the relative velocity between said heat exchange surface and said liquid, to facilitate removal of said nucleate bubbles.

24. The apparatus of claim 22 wherein said means for dissipating comprises:

means, disposed on said heat exchange surface, for forming nucleate bubbles of predetermined size and distribution to thereby increase heat flux.

25. The apparatus of claim 23 wherein said means for dissipating further comprises:

means, disposed on said heat exchange surface, for forming nucleate bubbles of predetermined size and distribution to thereby increase heat flux.

26. The apparatus of claim 22 wherein said substrate wheel includes first and second generally opposed surfaces and a peripheral edge surfaces interconnecting said generally opposed, said peripheral edge surface lying substantially normal to the axis of rotation of said wheel, said chill surface being disposed on said peripheral edge surface.

27. The apparatus of claim 22 wherein said substrate wheel includes first and second major surface and a peripheral surface interconnecting said major surfaces, said major surfaces lying substantially normal to the axis of rotation of said wheel, and said chill surface is disposed on said first major surface.

28. The apparatus of claim 27 wherein said chill surface includes a plurality of portions for receiving molten material.

29. The apparatus of claim 28 wherein at least one of said portions is sloped.

30. The apparatus of claim 29 wherein at least one of said portions is curved.

31. The apparatus of claim 27 wherein said chill surface is terraced.

32. In a chill block melt spinning apparatus of the type including a rotatable substrate wheel having a chill surface disposed to receive molten material, a heat exchange surface cooperating with said chill surface, and means for providing a flow of coolant liquid to remove heat from said heat exchange surface by formation of nucleate vapor bubbles on said heat exchange surface, the improvement wherein said apparatus includes:

means for controlling the time period during which said material is retained in contact with said chill surface.

33. The apparatus of claim 32 wherein said means for controlling the time period comprises means for selectively varying the speed of rotation of said wheel.

34. The apparatus of claim 33 wherein said means for controlling the time period further comprises projection members of predetermined geometry disposed on said chill surface.

35. The apparatus of claim 32 wherein said means for controlling the time period comprises projection members of predetermined geometry disposed on said chill surface.

36. The apparatus of claim 35 wherein said projection members are of a tapered geometry.

37. The apparatus of claim 35 wherein said projection members are of a radial geometry.

38. The apparatus of claim 35 wherein said projection members are of an undercut geometry.

39. In a chill block melt spinning apparatus of the type including a rotatable substrate wheel having a chill surface disposed to receive molten material, a heat exchange surface cooperating with said chill surface, and means for providing a flow of coolant liquid to remove heat from said heat exchange surface, and means for controlling the lengths of units of said material cast from said wheel, the improvement wherein said means for controlling said lengths comprises:

projecting members of predetermined geometry disposed on said chill surface.

* * * * *